United States Patent [19]

Kimmell

[11] 4,439,114

[45] Mar. 27, 1984

[54] PUMPING SYSTEM

[76] Inventor: Garman O. Kimmell, 3125 N. Virginia, Oklahoma City, Okla. 73118

[21] Appl. No.: 245,494

[22] Filed: Mar. 19, 1981

[51] Int. Cl.[3] ..... F04B 17/00

[52] U.S. Cl. ..... 417/403; 91/40; 91/323; 91/308

[58] Field of Search ..... 417/392, 396, 401, 403; 91/38, 40, 308, 323

[56] References Cited

U.S. PATENT DOCUMENTS

| | | | |
|---|---|---|---|
| 343,569 | 6/1886 | Cooper | 417/396 X |
| 1,893,440 | 1/1933 | Pagliuchi | 417/396 X |
| 2,904,011 | 9/1959 | Miley | 91/40 |
| 2,990,910 | 7/1961 | Kimmell | 183/2 |
| 3,133,472 | 5/1964 | Zollinger, Sr. | 91/308 X |
| 3,135,210 | 6/1964 | English | 91/40 X |
| 3,387,563 | 6/1968 | Williams et al. . | |
| 4,229,143 | 10/1980 | Pucher | 417/392 X |

*Primary Examiner*—Leonard E. Smith

*Attorney, Agent, or Firm*—William R. Laney

[57] ABSTRACT

A fluid operated pumping system which includes a main power cylinder divided into a power chamber and a pump chamber by a reciprocally mounted power piston. An actuator piston is connected to the power piston for synchronous movement therewith and is reciprocably mounted in an actuator cylinder. A diaphragm type four-way transfer valve is interposed between a power fluid source and the main power cylinder and actuator cylinder, to both of which the valve is connected, and functions to alternately and cyclically charge power fluid at a relatively high pressure to the power cylinder and actuator cylinder, and to concurrently discharge power fluid at a relatively low pressure. The system further includes a needle valve controlled, diaphragm-type, astable pneumatic amplifier which is connected to, and controls the movement of, the transfer valve. A check valve subassembly is associated with the pump chamber of the main power cylinder for concurrently pumping a secondary fluid at a relatively high discharge pressure.

25 Claims, 4 Drawing Figures

PUMPING SYSTEM

BACKGROUND OF THE INVENTION

1. Field of the Invention

This invention relates to pumping systems particularly useful for employing a relatively high pressure process fluid for pumping the same or another fluid from a relatively low pressure to a relatively high pressure after intervening treatment, and for process circulation of the process fluid at a rate governed by a needle valve controlled diaphragm-type pilot valve which is preferably an astable pneumatic amplifier. More particularly, the pumping system of the invention includes pumping elements which utilize the pressure-volume energy of a relatively high pressure process fluid to circulate this process fluid through a relatively low pressure fluid treatment zone, and then return it at elevated pressure to a zone of high pressure utilization in the process.

2. Brief Description of the Prior Art

Pumps have been devised which are particularly useful for circulating a liquid, such as a desiccant, in gas-liquid process systems having zones of the process within the circulation cycle under different pressures. Many of these are simple pumps of low overall efficiency in the process by reason of the fact that they do not utilize the pressure-volume energy available in circulated pressurized fluids which are used at elevated pressure at some point in the process, and are treated or utilized at a reduced pressure at a different point in the process. In such cases external power for driving the pump is used to repressure the fluid after treatment and preparatory to reuse.

One widely used pumping system devised to make use of the pressure-volume energy in a process fluid initially used in a relatively high pressure zone, then treated at a relatively low pressure, and finally repressurized and returned to the high pressure zone, is that which is illustrated and described in Kimmell U.S. Pat. No. 2,990,910. The Kimmell pump functions to circulate a desiccant liquid in a cycle which includes a high pressure vessel and a low pressure vessel in a way such that the proper liquid level is maintained in the high pressure vessel during the operation of the process. The Kimmell pump contains an internal pilot valve and pump transfer valve which in turn control the operation of the power pistons included in the pump. The construction of the pump is such that no stuffing boxes or pressure barriers are exposed to the atmosphere, thus eliminating the chance of any of the fluids passed through the pump being lost.

A snap action diaphragm-type control valve utilized to actuate and control the speed of operation of a pump is disclosed in Williams U.S. Pat. No. 3,387,563. In the control valve of Williams, a diaphragm is reciprocated in response to the pressure of a control fluid charged to the valve. A needle valve subassembly forming a part of the control valve is used to selectively vary the rate at which fluid pressure builds up on one side of the diaphragm. A ball check valve is provided within the control valve which, at the time that the diaphragm is fully displaced by fluid pressure on one side thereof, as built up after flow through the needle valve subassembly, opens to the atmosphere to relieve the pressure back through the needle valve, and thereby allow the diaphragm to return to its original position. The valve thus opens and closes periodically and automatically, according to the setting of the needle valve. The pulsations of the control valve in the manner described is used to control the stroke of a pump to which the valve is connected.

BRIEF DESCRIPTION OF THE PRESENT INVENTION

The present invention is directed to a pumping system operated by a fluid under relatively high pressure and used for the purpose of circulating that fluid in a process which entails both high pressure and relatively lower pressure process steps. The pumping system can be utilized for increasing the pressure of a process fluid from a lower pressure zone by transferring pressure-volume energy from a relatively high pressure fluid also employed in the process. The rate at which the pumping system operates is governed by a needle valve controlled, astable pneumatic amplifier functioning as a pilot valve which is used to selectively control the rate of shifting or cycling of a transfer valve forming a part of the system.

Broadly described, the pumping system of the invention includes a main power cylinder which is divided into a power chamber and a pump chamber by a reciprocally mounted power piston. An actuator piston is connected to the power piston for synchronous movement therewith, and is reciprocably mounted in an actuator cylinder. A diaphragm-type four-way transfer valve is interposed between a power fluid source in the main power cylinder and actuator cylinder, to both of which the valve is connected, and functions to alternately and cyclically charge power fluid at a relatively high pressure to the power cylinder and actuator cylinder, and to concurrently discharge power fluid at a relatively low pressure. The system further includes a needle valve controlled, astable pneumatic amplifier, functioning as a pilot valve, which is connected to, and controls the movement of, the transfer valve. A check valve subassembly is associated with the pump chamber of the main power cylinder and functions, concurrently with the operation of the power piston within the main power cylinder, to pump a secondary fluid from a relatively low input pressure to a relatively high discharge pressure.

An advantage of the present invention over the pumping system disclosed in my U.S. Pat. No. 2,990,910 is that the pressure of the power fluid required for operating the present pumping system can be as low as about 40 psi, whereas a pressure of at least 150 psi is required to operate the prior pumping system.

An object of the invention is to provide a reliable pumping system of the type described, which system is easily adjustable in its pumping rate, requires relatively little maintenance and has a relatively long operating life.

Additional objects and advantages will become apparent as the following detailed description of a preferred embodiment of the invention is read in conjunction with the accompanying drawings which illustrate such preferred embodiment.

BRIEF DESCRIPTION OF THE DRAWINGS

FIG. 3 is an enlarged view, partially in section, of an astable pneumatic amplifier constituting a part of the invention and functioning therein as a pilot valve.

DETAILED DESCRIPTION OF A PREFERRED EMBODIMENT OF THE INVENTION

The pumping system of the invention can be utilized in various applications where a fluid under a relatively high pressure at one point in a process is subsequently subjected to treatment, or is utilized, at a relatively lower pressure, and finally is repressurized and returned to the zone of high pressure utilization. The system is particularly useful where the high pressure utilization of the fluid entails the admixing of both gas and liquid, such as occurs where a gas-liquid extraction process is carried out under pressure.

Figure 1:
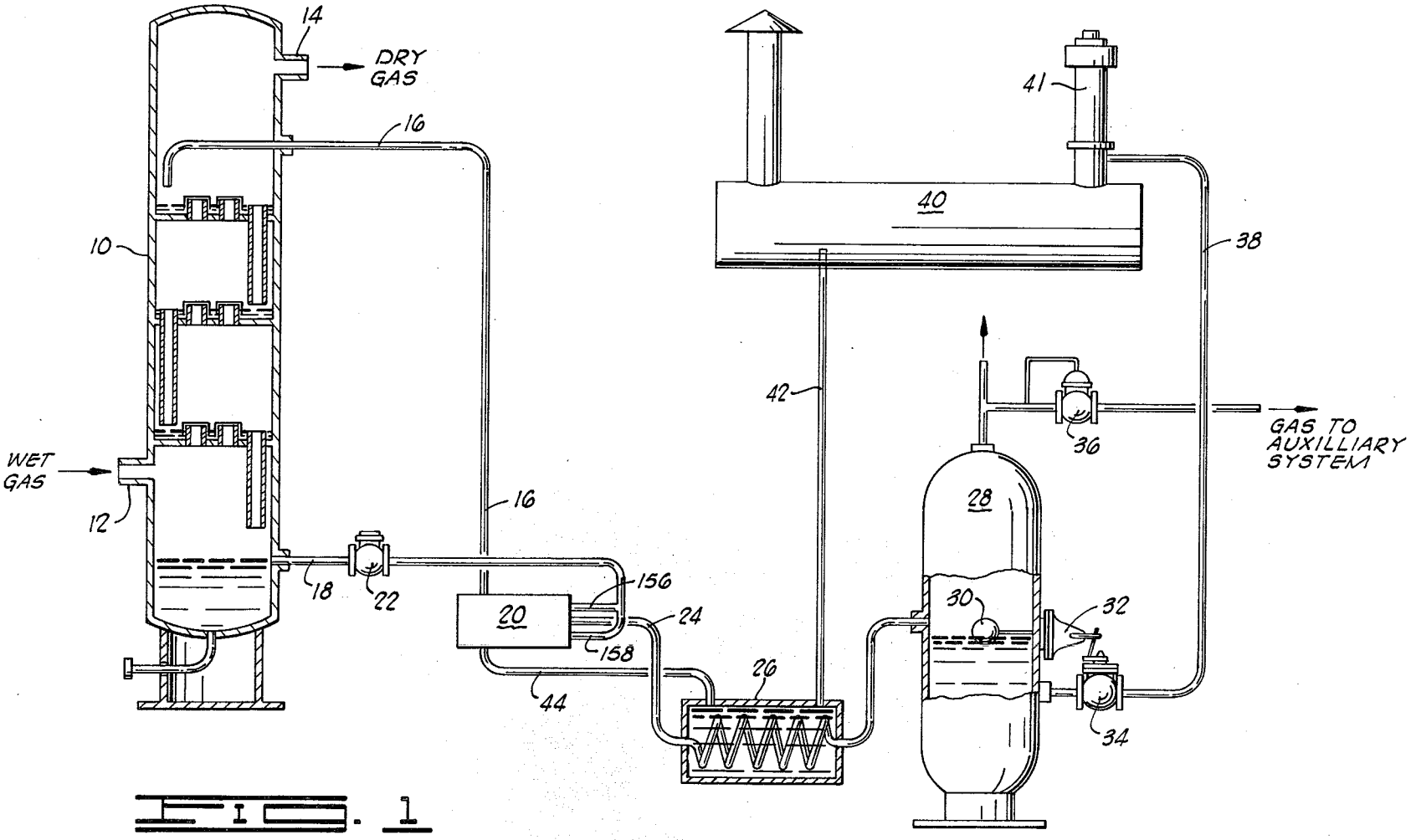
FIG. 1 is a diagrammatic illustration of a system incorporating the invention, wherein a liquid desiccant is brought into contact with a pressurized gas for the purpose of removing water vapor from the gas.

For purposes of illustrating the pumping system of the invention, such system is here described, by way of example, as it is utilized in a process where a liquid desiccant is used to remove water from a gas under pressure, such as natural gas coming directly from a gas well. The liquid desiccant is used to remove the water in an absorption tower where the desiccant contacts the gas while it is under pressure. The power fluid used to power the pumping system of the invention is the pregnant desiccant liquid from the absorption tower, which desiccant liquid contains water removed from the gas, and a variable amount of the gas. Although a system of this type is described in Kimmell U.S. Pat. No. 2,990,910, which is incorporated herein by reference, brief mention of the components of this system as shown in FIG. 1 will be here made in order to afford clarity in understanding the context of a typical application of the pumping system of the present invention. The pumping system can, of course, be used in other applications.

In FIG. 1 of the drawings, an absorption tower of tray design is designated by reference numeral 10. A gas under pressure, such as natural gas, containing undesirable quantities of water vapor, is admitted to the tower 10 through the wet gas inlet 12. Upon removal of the water vapor from the gas, the dry gas product is discharged from a dry gas outlet 14 at the top of the tower.

Glycol, constituting a liquid desiccant employed to remove the water vapor from the natural gas, is introduced to the absorption tower 10 from a feed line or conduit 16. The pregnant desiccant liquid containing the removed water, along with some amount of the gas, is removed from the absorption tower through the outlet line or conduit 18. The wet glycol and admixed gas at the pressure prevailing in the absorption tower 10 flows through the line 18 to the pumping system of the invention, designated generally by reference numeral 20, via an optional block valve 22.

The desiccant liquid containing an amount of the gas from the absorption tower 10 functions as power fluid to drive the pumping system 20. The power fluid is discharged from the pumping system 20 through a line 24 and through the coils within a heat exchanger 26. The power fluid from the heat exchanger 26 is charged to a flash tank 28 equipped with a liquid level controller which, in the illustrated embodiment, includes the float 30, trunnion 32 and lever valve 34. Gas separating from liquid desiccant in the flash tank 28 is passed through a back pressure valve 36 and can be utilized to supply auxiliary systems in the process. (For example, where natural gas is the gas being dried in the absorption tower 10, the gas removed from the flash tank 28 via the back pressure valve 36 can be used to fire boilers, or provide other heat supply functions.)

The wet desiccant leaving the flash tank 28 passes via discharge line 38 to a reboiler 40. In the reboiler, the wet desiccant is heated to drive off the water, which passes as steam through the top of the reflux section 41. The dry glycol desiccant is then passed from the reboiler 40 back to the pumping system 20 via a line 42 to the heat exchanger 26 and a line 44 from the heat exchanger to the pumping system. From the pumping system 20, the dry glycol is returned to absorption tower 10 via the line 16.

Figure 2:
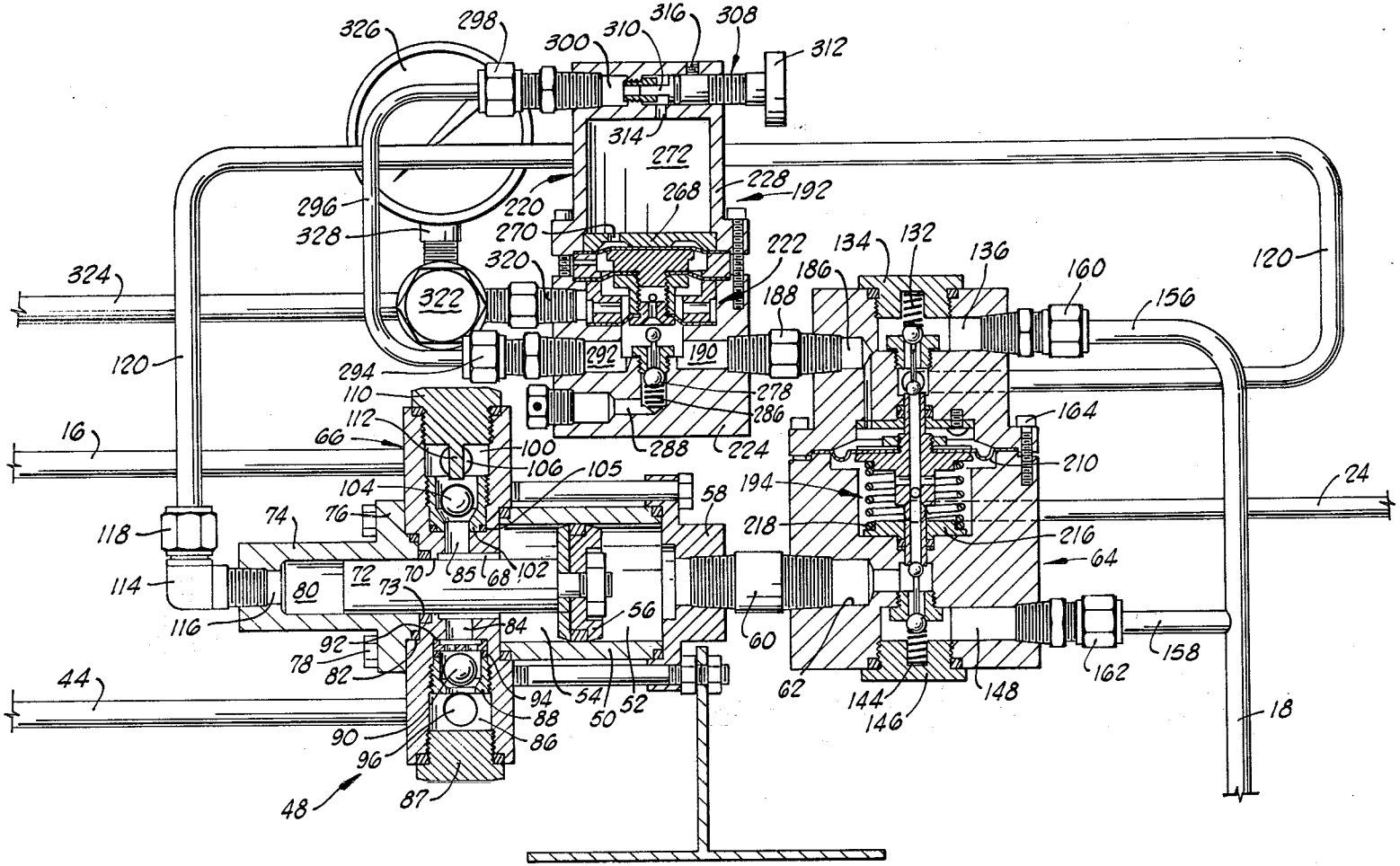
FIG. 2 is a view, partially in side elevation and partially in section, of the pumping system of the present invention which forms a part of the process system depicted in FIG. 1.
Figure 4:
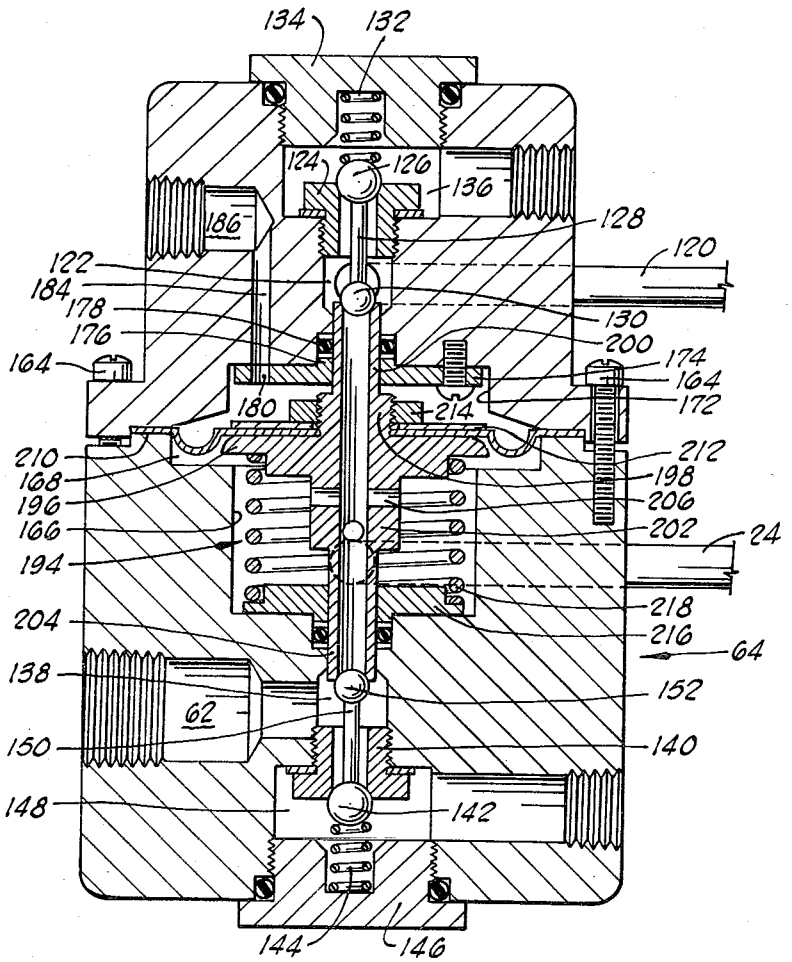
FIG. 4 is an enlarged view, partially in section, of the transfer valve constituting a part of the invention.
Figure 5:
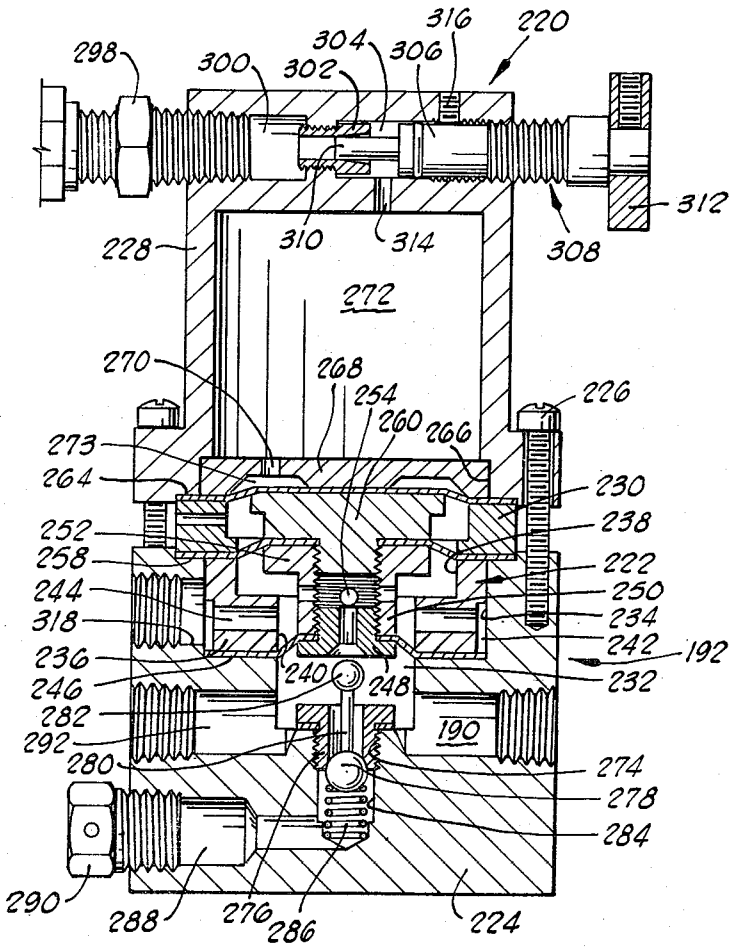

The novel pumping system 20 of the present invention is illustrated in detail in FIGS. 2–4 of the drawings. The pumping system contains a main pump unit 48 which includes a main power cylinder 50. The main power cylinder 50 is divided into a power chamber 52 and a pump chamber 54 by a power piston 56 reciprocably mounted in the power cylinder. The power cylinder 50 is closed at one of its ends by a centrally bored end plate 58 which receives one end of a threaded fitting 60. The other end of the threaded fitting 60 is threaded into a threaded port 62 of a four-way transfer valve designated generally by reference numeral 64 and hereinafter described in greater detail.

At its end opposite the end closed by the end plate 58, the power cylinder 50 is sealingly received in a recess formed in one side of a return fluid check valve subassembly, designated generally by reference numeral 66. Communicating with the recess in the check valve subassembly 66 which receives one end of the power cylinder 50 is a counterbore 68. The check valve subassembly 66 also includes a bore 70 formed in the housing of the check valve subassembly in concentric registry with counterbore 68. An elongated actuator piston 72 has one of its ends connected to the power piston 56 and extends concentrically through the counterbore 68 and slidingly through the bore 70 in the check valve subassembly 66. The actuator piston 72 is sealingly engaged by an O-ring seal 73 carried in the bore 70 of the check valve subassembly 66.

An actuator cylinder 74 carrying a radial flange 76 at one end thereof is bolted to the check valve subassembly 66 by means of bolts 78 and includes a chamber 80 which slidingly receives the actuator piston 72. A suitable sealing element 82 is provided between the flange 76 of the actuator cylinder 74 and the side of the check valve subassembly 66.

It will be noted that the main power cylinder 50, actuator cylinder 74 and the pistons movably mounted therein do not entail in such construction any stuffing boxes or packings around the moving piston parts, thus obviating any concern for loss of power fluid or pumped fluid to the atmosphere.

As explained, the counterbore 68 projected into one side of the check valve subassembly 66 is of larger diameter than, and concentrically surrounds, the actuator piston 72. Communicating with the counterbore 68 are a pair of check valve ports 84 and 85. The check valve port 84 opens into a relatively large diameter suction chamber 86 formed in a portion of the check valve subassembly housing and projecting radially outwardly from the counterbore 68 at the center of the housing. The suction chamber 86 is closed by a threaded closure cap 87 threaded into the radially outer open end of the suction valve chamber.

At its radially inner end, the chamber 86 is threaded to receive a check valve suction seat 88 which carries a beveled surface for sealingly engaging a ball valve element 90. A perforated valve element stop disc 92 seats on a shoulder located at the intersection of the chamber 86 and the port 84, and is retained there by an O-ring seal 94 compressed between the seat 88 and the stop disc 92. A suction port 96 is formed through one side of the housing of the check valve subassembly 66 and communicates with the chamber 86. The port 96 is connected to the line 44 which conveys dry desiccant liquid from the heat exchanger 26 to the pumping system 20.

The port 85 communicates with a relatively large diameter valve discharge chamber 100. The chamber 100 is internally threaded adjacent its radially inner end to receive an externally threaded discharge valve seat 102. The valve seat 102 includes a beveled seat surface which sealingly cooperates with a ball valve element 104. An O-ring seal 105 is positioned between the radially inner end of the valve seat 102 and a shoulder formed at the intersection of the chamber 100 and the port 85.

A discharge port 106 is formed through the housing of the check valve subassembly 66 at a location to communicate with the chamber 100. The port 106 is threadedly connected to one end of the line 16 used to convey dry glycol from the pumping system 20 to the absorption tower 10 as shown in FIG. 1. A closure cap 110 is threaded into, and closes, the radially outer end of the chamber 100. The closure cap 110 carries an inwardly projecting valve stop pin 112 which limits upward movement of the valve element 104.

An elbow 114 is threaded into a threaded port 116 formed in the end of the actuator cylinder 74 and has its other end connected through a fitting 118 to a conduit 120. The conduit 120 extends to the transfer valve 64 and is connected through a port formed in the housing of the transfer valve to a first chamber 122 within the transfer valve (see FIG. 4).

One end of the chamber 122 receives a threaded valve seat 124. The valve seat 124 has, at its upper side as viewed in FIG. 2, a beveled surface for sealing cooperation with a spherical valve element 126. The valve element 126 is secured to one end of a valve rod 128 which projects through a bore through the valve seat 124 and is secured at its opposite end to a spherical valve element 130. The valve element 126 is biased against the beveled surface of the seat 124 by a helical spring 132 seated in a recess formed in a threaded closure cap 134 threaded into a large opening formed in the upper end of the housing of the transfer valve 64. The closure cap 134 affords closure to a relatively large fluid charging chamber 136.

Structure similar to that which has been described thus far in referring to the transfer valve 64 is also located at the opposite side of the transfer valve. Thus, a chamber 138 is provided and is closed by a threaded valve seat 140 which carries a beveled seat accommodating a spherical valve element 142. The valve element 142 is biased against the seat 140 by a helical spring 144 seated in a recess formed in a threaded closure cap 146. The threaded closure cap 146 closes a second charging chamber 148. The valve element 142 is secured to one end of an elongated valve rod 150 which is secured at its other end to a spherical valve element 152.

The chamber 138 communicates through a suitable opening with the port 62 which threadedly receives the fitting 60 as hereinbefore described. To facilitate charging pressurized fluid to the chambers 136 and 148, a pair of branch conduits 156 and 158 are connected, respectively, through fittings 160 and 162 to these chambers. The branch conduits 156 and 158 branch from the outlet line 18 in the manner illustrated in both FIGS. 1 and 2.

The function of the four-way transfer valve 64 is to charge relatively high pressure process fluid received from a high pressure zone in the process alternately to chambers 52 and 80, and also to discharge process fluid from the main pumping unit 48 to a zone of utilization or treatment at relatively low pressure after it has been used to power the pumping system. In order to achieve these functions in a cylically timed fashion, a diaphragm-type actuation system is provided within the transfer valve 64.

FIGS. 2 and 4 show that the body of the four-way transfer valve 64 is made of two parts, an upper part and a lower part, bolted to each other by bolts 164. The lower part of the valve body defines a relatively large chamber 166 which opens at its upper end into an enlarged recess 168. The recess 168 is adjacent recessed chamber 172 formed in the lower end of the upper part of the valve body.

A centrally bored back-up retainer plate 174 is secured by screws to the valve body at the top of the recess 172, and carries a centrally bored neck 176 which accommodates an O-ring seal 178 at a location where the neck projects into a complementary recess in the upper part of the body of the transfer valve 64. The retainer plate 174 also defines a relatively small opening or orifice 180 to permit fluid to be charged to chamber 172 from a relatively small capillary passageway 184. At its end opposite the orifice 180, the capillary passageway 184 communicates with a threaded port 186 formed in one side of the body of the transfer valve 64. The port 186 receives one end of a threaded fitting 188. The fitting 188 has its other end threaded into a port 190 formed in the side wall of a needle valve controlled, astable pneumatic amplifier subassembly, designated generally by reference numeral 192 and hereinafter described in greater detail.

The diaphragm-type valve actuator utilized in the transfer valve 64 includes a double seat core element designated generally by reference numeral 194. The core element 194 includes a central disc 196 sized to contact the shoulder at the intersection of the chamber 166 with the recess 168 at a time during operation of the transfer valve. The central disc 196 has an upwardly projecting threaded neck 198 which is formed integrally with a tubular stem 200. The central disc 196 also carries a downwardly projecting neck 202 which carries at its lower end a downwardly projecting tubular stem 204.

It will be noted that the passageways through the tubular stems 200 and 204 are in alignment with and communicate with a central passageway formed through the upwardly projecting threaded neck 198, the central disc 196 and the downwardly projecting neck 202. Fluid can thus flow from either the top or the bottom of the core element 194 toward the center thereof, depending on which of the valve elements 130 or 152 is in a closing relationship to the respective openings at the ends of the two tubular stems 200 and 204. In this regard, it may be noted that a slight taper is provided at that location on the wall of each of these stems where the passageway therethrough opens, so that the valve elements 130 and 152 can seat against and seal these openings during operation of the transfer valve. Radial passageways 206 extend through the downwardly projecting neck 202 of the double seat core element and intersect the tubular passageway through this neck so that fluid flowing in this passageway can pass out through the neck into the chamber 166. Entering the lower portion of the housing of the transfer valve 64 at a location on the opposite side of the valve from that which can be seen in FIG. 2 is a discharge port to which the process fluid discharge line 24 is connected. The discharge line 24 thus can receive fluid from the chamber 166.

A flexible diaphragm 210 is extended across the flat upper side of the disc 196 of the core element 194 and has its outer peripheral edge secured between the upper and lower parts of the body of the transfer valve 64. The central portion of the diaphragm 210 is retained in contact with the upper side of the central disc 196 by a diaphragm washer 212 which bears flatly against the upper surface of the diaphragm and is retained against the diaphragm by a suitable nut 214 threaded upon the upwardly projecting threaded neck 198.

A spring retainer plate 216 is centered in the bottom of the chamber 166 and is peripherally grooved to accommodate and center one end of a helical compression spring 218 which bears at its other end against the lower side of the disc 196.

The transfer valve 64 is periodically shifted by the needle valve controlled, astable pneumatic amplifier, which thus functions as a pilot valve 192. The astable pneumatic amplifier 192 includes a needle valve subassembly 220 and a diaphragm actuator subassembly 222. The diaphragm actuator subassembly includes a housing 224 which has the threaded port 190 formed in one side thereof as hereinbefore explained, and which is secured by bolts 226 to a needle valve housing 228. The needle valve housing 228 and housing 224 bear against, and retain between them, an annular diaphragm housing 230.

The housing 224 defines a central control gas chamber 232 which opens into a relatively large diameter spool chamber 234. The spool chamber 234 accommodates a spool 236 which is a generally cylindrically shaped body which is provided with a relatively large counterbore 238 in the upper portion thereof and a relatively smaller diameter bore 240 in the lower portion thereof. The lower outer peripheral portion of the spool 236 is relieved to provide a peripheral recess 242 at that location, affording clearance between the spool and the wall of housing 224 which defines the spool chamber 234.

A plurality of radial openings 244 extend between the peripheral recess 242 and the bore 240 of the spool. The lower end face of the spool 236 bears against the outer peripheral portion of a flexible lower diaphragm 246. Adjacent its central portion, the lower diaphragm 246 is secured between a radial flange carried on a threaded valve seat 248 and a diaphragm spacer 250. The valve seat 248 is threaded into a bore formed centrally through a diaphragm spacer 250.

The diaphragm spacer 250 carries a flange 252 at its upper end, and the bore through the spacer is threaded at this location. Below the flange 252 and above the valve seat 248, several radial ports or openings 254 project through the walls of the diaphragm spacer to the central bore to afford communication from the outer side of the spacer to the central bore. It will be noted that the diaphragm spacer 250 and the valve seat 248 are diametrically dimensioned so that the outer walls of the spacer and seat are spaced radially inwardly from the internal wall of the housing 224 which defines the central fluid chamber 232.

A central flexible diaphragm 258 has a central portion which is clamped between the upper surface of the flange 252 and a diaphragm plate 260 having a threaded neck portion projecting downwardly therefrom and threadedly engaged with the threaded upper end of the bore through the diaphragm spacer 250. The outer peripheral portion of the central diaphragm 258 is clamped between the diaphragm housing 230, which bears on the diaphragm from above, and the upper end of the spool 236 and an upper end portion of the housing 224.

An upper flexible diaphragm 264 extends across the flat upper side of the diaphragm plate 260 and has its outer peripheral edge clamped between the diaphragm housing 230 and the lower side of the needle valve housing 228. The lower end of the needle valve housing 228 is bored as shown at 266 to receive a stop plate 268 which is pressed into the bore. The stop plate 268 has one or more openings 270 therethrough to permit fluid to flow from a large chamber 272 in the needle valve housing to an annular recess or trough 273 formed in the lower side of the stop plate and over the upper diaphragm 264.

A threaded bore 274 is formed in the bottom of the central fluid chamber 232 and receives a threaded valve seat 276. At its lower end, the valve seat 276 includes a beveled seat which cooperates with a spherical valve element 278 secured to the lower end of a valve rod 280. At its other end, the valve rod 280 is secured to a spherical valve element 282 which is dimensioned to mate with and seat upon a beveled seat formed in the threaded valve seat 248. Upon displacement from the valve seat 276, the valve element 278 moves downwardly in a spring chamber 284 which accommodates a helical compression spring 286. The spring 286 bears against the valve element 278 and resiliently urges it toward the seat 276. The spring chamber 284 communicates with an atmospheric vent port 288 which is closed by a threaded breather plug 290.

As shown in FIG. 3, the central control gas chamber 232 in the valve housing 224 communicates with the port 190 hereinbefore described. The chamber 232 also communicates with a first needle valve transfer port 292 which communicates, via a suitable threaded fitting 294, conduit 296 and threaded fitting 298, with a second needle valve transfer port 300 formed in the upper portion of the needle valve housing 228.

The port 300 is adjacent a control orifice fitting 302. The fitting 302 is threaded into an internally threaded, radially inwardly projecting annular shoulder formed within the needle valve housing 228 at a location between the port 300 and a relatively large radial bore 304. The bore 304 is internally threaded to receive the threaded shank portion 306 of a needle valve control element, designated generally by reference numeral 308. The control element 308, in addition to the shank portion 306, includes a speed adjustment stem 310 and a control knob 312. At a location between the fitting 302 and the shank portion 306, an opening 314 is formed through an internal wall of the needle valve housing 228 so as to place the bore 304 in communication with the chamber 272. A set screw 316 is provided through the upper side of the needle valve housing 228 at a location in alignment with the shank portion 306 to permit the control element 308 to retain its adjusted position against loosening and maladjustment resulting from vibration.

The space defined by the peripheral recess 242 around the lower portion of the spool 236 communicates with a threaded gas charging port 318 which receives one end of a threaded fitting 320. The other end of the fitting 320 is threaded into a filter element 322. A control gas is charged to the filter element 322 from a source (not shown) via a control gas conduit 324. A pressure gauge 326 is connected through a fitting 328 to the filter element 322 and functions to sense and provide a readout of the pressure of a control gas charged to the needle valve controlled, astable pneumatic amplifier 192.

OPERATION

Since the pumping system of the invention is suitable for a number of varient usages in various processes, its general operation will initially be described by reference to FIG. 2. Subsequently, a typical application of the pumping system as it is used for pumping a glycol desiccant in a gas drying system of the sort shown in FIG. 1 will be described.

In the use of the pumping system, a process stream which includes a fluid containing at least some liquid, and existing at relatively high pressure, is charged to the pumping system through the conduit or line 18. The pressurized process fluid is divided at the branch conduits 156 and 158 so that it is charged to the first and second fluid charging chambers 136 and 148, respectively, of the transfer valve 64.

The status of the transfer valve 64 is determined by the status of the needle valve controlled, astable pneumatic amplifier 192. As the transfer valve 64 is illustrated in FIG. 2, it is actually in a transitory neutral position which is only momentarily attained during operation of the pump system. In this neutral position, it will be noted that all of the spherical valve elements 126, 130, 142 and 152 are seated upon their respective seats, and that for this reason none of the pressurized fluid flows, at this instant, from the respective first and second fluid charging chambers. In point of fact, this neutral status of the transfer valve is very momentary and transitory so as to cause little impediment to flow of the pressurized process fluid into and through the pump system.

The cyclical change of status of both the transfer valve 64 and the main pump 48 is effected and controlled by the needle valve controlled, astable pneumatic amplifier 192. This device is operated in response to a control gas charged from a suitable source through the conduit 324. The control gas, which may typically be charged to the astable pneumatic amplifier 192 at a pressure of from about 30 to 50 psi, passes through the filter 322, and at the same time provides an indication of its pressure on the pressure gauge 326.

After being filtered, the control gas enters the astable pneumatic amplifier 192 through the port 318. From the port 318, the control gas passes into the peripheral recess 242 around the spool 236. It then passes through the radial openings 244 and enters the space around the diaphragm spacer 250 and between the central diaphragm 258 and lower diaphragm 246. A larger area of the central diaphragm 258 is exposed to the pressurized control gas than the area of the lower flexible diaphragm 246 which is so exposed, and therefore the force imposed on the central flexible diaphragm 258 tends to cause the diaphragm actuator subassembly 222 to move upwardly relative to the diaphragm housing 230 and the spool 236. Upward movement of the central diaphragm 258, the diaphragm plate 260 and diaphragm spacer 250 associated and movable therewith, is opposed by gas pressure acting against the upper surface of the upper diaphragm 264. The manner in which the needle valve control element 308 is used to control and regulate these opposing gas pressures will be subsequently explained.

With the diaphragm actuator subassembly 222 in the status shown in FIG. 2, resulting from a greater force acting upwardly on the flexible diaphragm than acts downwardly, the spherical valve element 282 is disengaged from the valve seat 248. Thus, the pressurized gas, which can enter the interior of the diaphram spacer through the radial openings 244 and 254, can pass through the bore in the valve seat 248 and enter the central fluid chamber 232.

The control gas in the central fluid chamber 232 can pass through the port 190, the fitting 188 and the port 186 into the transfer valve 64. The control gas can concurrently pass through the transfer port 292, the fitting 294, the conduit 296, the fitting 298 and enter the needle valve housing 228 via the transfer port 300. From this location, the control gas bleeds past the tapered speed adjustment stem 310 of the needle valve and thus initially undergoes a substantial pressure drop. The rate at which the gas bleeds past the speed adjusting stem 310 can be controlled by the extent to which the control knob 312 is turned to extend the tapered stem into the fitting 302. As will be perceived from the ensuing discussion, the described adjustment of the needle valve controls the period of a complete cycle of the system, including the period of throw of the transfer valve 64. The control gas initially passes at a reduced pressure through the opening 314 and commences to fill and become pressurized within the chamber 272. The control gas also passes through the opening 270 in the stop plate 268 and commences to fill the space over the upper diaphragm 264.

The control gas transmitted to the port 186 of the transfer valve 64 passes through the capillary passageway 184 and through the opening 180 in the back-up retainer plate 174 to fill the chamber 172 over the diaphragm 210. As the gas pressure in the chamber 172 continues to increase, the force acting downwardly on the diaphragm 210, and tending to move the diaphragm, and the double seat core element 194 to which it is attached, downwardly, will also increase. This downwardly acting force is opposed by the compression spring 218. Ultimately, however, the control gas pressure in the chamber 172 exceeds the opposing force developed by the spring 218 and the double seat core element 194 moves downwardly.

As the double seat core element 194 moves downwardly, the seat formed at the upper end of the stem 200 moves downwardly to the point where the valve element 130 is unseated. At the same time, the tubular stem 204 is forced downwardly from its illustrated position, thereby forcing the valve element 152, the valve rod 150 and the valve element 142 downwardly. Downward movement of the valve element 142 is opposed by the helical spring 144, but the principal function of the spring is merely to keep the valve element 142 on its respective seat against the force of gravity when it is not forcibly pushed from the seat by downward movement of the core element 194.

As the valve element 142 is forced off its seat 140, pressurized process fluid from the charging chamber 148 can pass through the seat 140, into the second fluid discharge chamber 138, and from this chamber the pressurized process fluid can pass through the port 62, the fitting 60 and into the power chamber 52 of the main power cylinder 50. It will be noted that during the described movement of the double seat core element 194, the valve element 152 remains in the seat formed at the lower end of the downwardly projecting tubular stem 204, and thus pressurized process fluid is prevented from entering the passageway which extends through the tubular stem 204 and through the center of the entire core element 194.

The pressurized power fluid acts on the large exposed face of the power piston 56 and forces the power piston toward the left within the main power cylinder 50. As the power piston 56 moves toward the left, it forces the actuator piston 72 ahead of it to discharge from the chamber 80 pressurized process fluid which has been delivered to this chamber during a previous portion of the pump system cycle. It will be noted that the effective area of the pumping face of the power piston 56 sweeping pump chamber 54 is substantially less than the area of the exposed right face of the power piston 56 so that, though the process fluid in both the power chamber 52 and the pump chamber 54 are at substantially the same pressure, the force applied to move the power piston 56 and pump piston 72 toward the left is substantially greater than the force opposing this movement. The pressurized process fluid which is forced out of the pump chamber 54 enters the line 16 through the counterbore 68, check valve port 85 and discharge port 106.

Recalling the status of the valve element 126, valve rod 128 and valve element 130 at this time, it will be noted that the spherical valve element 130 is not seated upon the valve seat at the upper end of the stem 200 of the double seat core element 194, since the double seat core element, including this stem, has been forced downwardly by reason of the pressure of the control gas in the chamber 172 exceeding the opposing force developed by the spring 218. The depressurized process fluid from the chamber 80 is thus free to pass through the bore or passageway through the stem 200. Pressurized process fluid is prevented, however, from entering the lower end of the downwardly projecting tubular stem 204 since this stem and its associated valve seat is, at this time, closed by the valve element 152.

The depressurized process fluid flowing through the central passageway through the stem 200 and the central disc 196 of the double seat core element 194 can, however, pass out through the radial passageways 206 into the chamber 166. From the chamber 166, the process fluid can pass through a port in the housing of the transfer valve and enter the line 24. The line 24 conveys the process fluid to a point where it is subjected to treatment, at relatively low pressure, for restoration to a status suitable for reuse in a high pressure step of the process.

As the power piston 56 continues to move toward the left within the power cylinder 50, the control gas pressure continues to build up throughout the spaces occupied by it in the status of the transfer valve 64 and the astable pneumatic amplifier 92 hereinbefore described. Thus, pressure continues to increase in the chamber 172 over the diaphragm 210 as the pressure of the control gas in the chamber 272 in the needle valve housing 228 also continues to increase as gas bleeds by the speed-adjusting stem 310 of the needle valve control element 308.

It will be noted that the surface area over the upper diaphragm 264 is substantially larger than the surface area of the central diaphram 258 which is exposed to the pressurized control gas which acts on it in the space between the diaphragm spacer 250 and the spool 236. It is also substantially larger than the area of the lower diaphragm 246 which is exposed to control gas pressure. Thus, at some point during the pressure build-up in the chamber 272, the acting force becomes sufficient, considering the relatively larger surface area of the upper diaphragm 264 upon which the control gas acts, to force the diaphragm actuator subassembly 222, including the upper diaphragm, diaphragm plate 260, diaphragm spacer 250 and lower diaphragm 246, downwardly to the point where the spherical valve element 282 seats upon the valve seat 248, and the spherical valve element 278 is pushed off of its seat 276 against the opposing bias of compression spring 284.

Prior to the time that the valve element 282 contacts the upper side of the valve seat 276, the lower side of the flange carried at the upper end of the diaphragm spacer 250 contacts the upper side of the spool 236 to arrest further downward movement of the diaphragm actuator subassembly 222. The bore or passageway through the valve seat 276 is thus open to the passage of the control gas through this valve seat and to the atmospheric vent port 288. Pressurized gas at this location can be vented to the atmosphere through the threaded breather plug 290.

The effect of this is to vent the control gas to the atmosphere at the time that the diaphragm actuator subassembly 222 is forced downwardly. This reduction of control gas pressure in turn allows the pressure of the gas over the diaphragm 210 in the transfer valve 64 to be relieved, which in turn will permit the helical compression spring 218 to force the double seat core element 194 upwardly, thus reversing the position of the transfer valve. At this time, the upper tubular stem 200 moves upwardly to unseat the valve element 126, and the downwardly projecting tubular stem 204 concurrently moves upwardly to allow the valve element 142 to be returned to its seat by the spring 144.

With this change of status of the transfer valve 64, the pressurized process fluid entering the fluid charging chamber 136 can pass through the bore through the valve seat 124 and out through the port to which the tubing 120 is connected. The chamber 80 is thus placed in communication with the line 18 which brings the relatively high pressure process fluid to the pump system. Concurrently, the presurized process fluid which has acted against the right face of the power piston 56 to drive this piston and the actuator piston 72 to the left can be exhausted through the fitting 60, the port 62 and through the now opened bore or passageway through the downwardly projecting tubular stem 204 to a location within the double seat core element 194 where the pressurized process fluid can pass through the radial passageways 206 into the chamber 166. From this chamber, the process fluid can enter the line 24 for conveyance to the downstream relatively low pressure treating zone.

It should be noted that at the time the power piston 56 is being forced to the left, relatively low pressure process fluid which has been treated to condition it for return to the high pressure zone in the process is forced from the pump chamber 54, through the bore 68, and through the port 85 past the unseated ball valve 104 into the discharge valve chamber 100. The low pressure process fluid has been previously drawn into the pump chamber 54 during a suction stroke of the power piston 56 when it is being moved to the right within the power cylinder 50. This suction stroke has the effect of opening the check valve constituted by the valve element 90 and its associated seat 88 so that the process fluid, which may be derived from the downstream, relatively low pressure treating zone, can be drawn through the suction port 96 and into the suction valve chamber 86. Upon discharging the process fluid via the check valve port 85, discharge valve chamber 100, discharge port 106 and feed line 16, the process fluid can be pumped to the high pressure required in the upstream high pressure zone employed in the process, and constituting the source, after carrying out the high pressure step, of the pressurized process fluid charged to the pumping system through the line 18.

From the described operation of the pump system of the invention, it will be perceived that the pilot valve 192 is used to control the transfer valve 64 so that the speed at which this valve changes position, and therefore the speed at which the stroke of the power piston 56 is reversed, can be selectively controlled. Such control is attained by the adjustable setting of the needle valve control element 308. Thus, by closing the needle valve slightly, the time period which is required for the pressure to build up over the upper diaphragm 264 sufficiently to force the diaphragm actuator subassembly 222 downwardly, thus venting the control gas to the atmosphere in the manner described, and allowing the transfer valve 64 to shift, can be extended or enlarged. The opposite effect can be obtained by opening the needle valve control element 308 so that pressure of the control gas in the chamber 272 increases more rapidly and in closer correspondence to the rate of increase of pressure in the central fluid chamber 232. At the time that the diaphragm actuator subassembly 222 shifts, the action is a snap action which avoids any significant pressure surges in the line 18 as a result of any more than a very transitory or momentary centering of the diaphragm 210 of the transfer valve.

A particularly valuable usage of the pumping system of the invention is for the purpose of circulating glycol in a water vapor extraction system of the type shown in FIG. 1. Here, where natural gas under pressure has been charged to the absorption tower 10 and the entrained water vapor removed therefrom by absorption in glycol charged to the top of the tower through the conduit 16, the wet glycol is then removed from the absorption tower through the line 18, along with an amount of the natural gas. This fluid mixture of glycol, water and natural gas is then charged to the pump system 20 through the branch conduits 156 and 158. At this time, the liquid and gas mixture charged through these branch conduits is under relatively high pressure—substantially the same pressure as that which prevails in the absorption tower 10 during the absorption step.

The pressurized fluid mixture is then alternatively charged, by means of the cyclically thrown transfer valve 64, to either the power chamber 52 to the right of the power piston 56 in the power cylinder 50, or to the chamber 80 to the left of the actuator piston 72 which reciprocates in the actuator cylinder 74. The transfer valve 64, under control of the astable pneumatic amplifier 192, also functions to receive pressurized wet glycol and gas discharged from the power chamber 52 or chamber 80, depending on the phase of the stroke of the piston elements carried therein, and to pass the wet glycol to the heat exchanger 26 and flash tank 28 located downstream from the pump system. The glycol, constituting the desiccant liquid used in the process, is thus being circulated by the pump system 20. Concurrently, the check valve subassembly 66 which is associated with the pump chamber 54 of the power cylinder 50 is functioning to alternately feed dry glycol from the reboiler 40 via the heat exchanger 26 to the pump chamber 54, and then, on the reverse stroke of the power piston 56 (the discharge stroke), through the line 16 to the top of the absorption tower 10 for reutilization in the high pressure absorption of moisture from the natural gas charged to the tower. The pressure of the dry glycol can be substantially increased to permit it to be injected into the absorption tower 10 as it is operated under pressure by reason of the relatively large surface area of the right side of the power piston 56 as compared to the exposed surface area on the left side of this piston.

From the foregoing description of the invention, it will be seen that the pump system of the invention provides a compact, efficient and easily utilized system for circulating a process fluid from a zone of high pressure utilization to a zone of lower pressure where treatment of the fluid or some other operation is carried out, followed by recirculation of the lower pressure fluid back to the high pressure zone after pressurization by means of the pump system. It further provides an effective speed control pilot valve, here in the form of an astable pneumatic amplifier, which is quickly and easily adjusted to control the speed of operation of the main pump.

Although various parts and relationships of structural elements to each other have been herein described in detail, it will be understood that various changes and innovations in these parts and elements can be effected without departure from the basic principles of the invention, and the basic mode of operation herein described. Changes and innovations of this type are therefore deemed to be circumscribed by the spirit and scope of the invention, except as the same may be necessarily limited by the appended claims or reasonable equivalents thereof.

What is claimed is:

1. In a gas treating system in which liquid impurity absorbent contacts a pressurized, impurity-containing gas in a contactor, followed by treatment of the impurity-containing absorbent in a treater at a reduced pressure preparatory to returning the absorbent to the contactor, the improvement which comprises:

a pressure-volume energy exchange pump connected to the contactor and driven by a mixture of impurity-containing absorbent and gas from the contactor;

means connected to the pump for transferring absorbent from the treater to the contactor via the pump while elevating the pressure of the absorbent by use of the pump;

a four-way transfer valve connected to the pump for concurrently charging impurity-containing pressurized absorbent and gas to the pump from the contactor, and for discharging impurity-containing absorbent and gas from the pump to the treater via the four-way transfer valve; and a needle valve controlled, diaphragm-type astable pneumatic amplifier pilot valve drivingly connected to said four-way transfer valve.

2. A transfer valve responsive to actuation by a pulsed control fluid which is periodically increased and alternately decreased in pressure as charged to such transfer valve for periodically shifting the transfer valve, the transfer valve comprising:

a first chamber adapted for connection to a first cylinder for periodically receiving pressurized fluid therefrom, and alternately periodically supplying pressurized fluid thereto;

a second chamber adapted for connection to a second cylinder for periodically receiving pressurized fluid therefrom and alternately periodically supplying pressurized fluid thereto;

a first pressurized fluid charging chamber;

a second pressurized fluid charging chamber;

means for concurrently supplying a pressurized fluid to said first and second pressurized fluid charging chambers;

a fluid discharge chamber;

a double seat core element partially positioned in said fluid discharge chamber and including tubular stem means for communicating said dischage chamber with said first and second chambers; and compound spherical valve element means positioned between said first chamber and said first pressurized fluid charging chamber, between said first pressurized fluid charging chamber and said tubular stem means, between said second pressurized fluid charging chamber and said tubular stem means, and between said second chamber and said second pressurized fluid charging chamber;

a control fluid chamber for receiving a pulsed control fluid;

diaphragm means connected to said double seat core element and separating said control fluid chamber from said fluid discharge chamber; and means resiliently opposing movement of said diaphragm and double seat core element under the impetus of relatively highly pressurized control fluid.

3. A fluid treatment system comprising:

an absorption zone for contacting, at a relatively high pressure, an impure first fluid with a liquid extractant for absorbing impurity from said first fluid;

a treating zone at substantially lower pressure than said absorption zone for treating said impurity-containing extractant to release said impurity and purify said extractant; and a pumping system for transferring pressure-volume energy from said impurity-containing extractant to said purified extractant after treatment, and concurrently circulating said extractant from said absorption zone to said treating zone, and then back to said absorption zone, said pump system comprising:

a main power cylinder;

a reciprocating piston dividing the main power cylinder into a power chamber and a pump chamber;

valve means associated with the pump chamber for introducing purified extractant to said pump chamber and discharging it from said pump chamber at increased pressure;

actuating means associated with said piston for reciprocation therewith and for pumping impurity-containing extractant upon movement of the piston in one direction, and for responding to charged impurity-containing extractant to move said piston in the opposite direction;

a transfer valve connected to said absorption zone and to said main power cylinder and actuating means for charging relatively high pressure impurity-containing extractant from said absorption zone alternately to said power chamber and then cyclically to said actuating means, and concurrently continuously receiving impurity-containing extractant liquid from the power cylinder and actuating means for circulation to said treating zone; and a needle valve-controlled pilot valve connected to said transfer valve for automatically and selectively, by needle valve adjustment, controlling periodic and cyclical changes of status of said transfer valve.

4. A fluid treatment system as defined in claim 3 and further characterized as including means for charging a control fluid to said needle valve controlled pilot valve.

5. A fluid treatment system as defined in claim 3 wherein said pilot valve comprises means for charging a control fluid to said transfer valve for a selectively predetermined time interval, and then suddenly venting said control fluid to the atmosphere.

6. A fluid-operated pumping system comprising:

a main pump adapted to be powered by a relatively high pressure fluid to pump a fluid from a relatively low pressure to a higher pressure and including:

a main power cylinder;

a power piston reciprocably mounted in the power cylinder and dividing the power cylinder into a power chamber and a pump chamber;

an actuator cylinder;

an actuator piston reciprocably mounted in the actuator cylinder and connected to the power piston for mutual reciprocation therewith; and a check valve subassembly associated with the pump chamber in the main power cylinder for alternately admitting fluid into said pump chamber during a suction stroke of the power piston, and discharging fluid from said pump chamber during a discharge stroke of the power piston;

a transfer valve for directing said relatively high pressure fluid in alternating fashion to said power chamber and into said actuator cylinder to drive said power piston and actuator piston in reciprocation, and concurrently receiving and circulating low pressure fluid from said main pump;

a needle valve controlled pilot valve connected to, and controlling the movements of, said transfer valve;

a single fluid charging connection constituting the sole connection between said pilot valve and said transfer valve for charging a control fluid to said transfer valve to periodically shift said transfer valve, said needle valve controlled pilot valve further having a single input means for continuously charging a control fluid under pressure to said needle valve controlled pilot valve, and said needle valve controlled pilot valve including a single needle valve interposed in the path of control fluid continuously charged to said pilot valve from said single input means for controlling the rate at which the pressure of the control fluid charged through said single fluid charging connection to said transfer valve builds up within said transfer valve, and consequently, the period at which said transfer valve cyclically directs said high pressure fluid in alternating fashion to said power chamber and into said actuator cylinder.

7. A pumping system as defined in claim 6 wherein said pilot valve includes an astable pneumatic amplifier connected by said single fluid changing connection to said transfer valve.

8. A pumping system as defined in claim 6 wherein said check valve subassembly comprises:

a suction chamber;

a suction check valve positioned between said suction chamber and said pump chamber;

a discharge chamber; and a discharge check valve positioned between said discharge chamber and said pump chamber.

9. A pumping system as defined in claim 6 wherein said pilot valve comprises:

valve housing means;

diaphragm means in said housing means and movable from a first control position to a second control position in response to changes in fluid pressure acting on at least one side of said diaphragm means;

first valve means movable in response to movement of said diaphragm means to periodically reduce the pressure in a control fluid within a portion of said housing means on one side of the diaphragm means;

said single needle valve being operatively associated with said diaphragm means to control the rate of increase of fluid pressure acting on the opposite side of said diaphragm means from that side upon which fluid pressure is periodically reduced by movement of said first valve means;

said single input means including means for concurrently charging a control fluid under pressure through said needle valve into said housing means on said opposite side of said diaphragm means, and into said portion of said housing means on said one side of said diaphragm means; and said single fluid charging connection connecting said portion of said housing means on one side of said diaphragm means to said transfer valve for communicating fluid between said portion of said housing means and said transfer valve.

10. A pumping system as defined in claim 9 wherein said concurrently charging means comprises a conduit placing the fluid in said portion of said housing means on one side of said diaphragm means in fluid communication with said needle valve.

11. A pumping system as defined in claim 9 wherein said means for concurrently charging a control fluid through said needle valve into said housing, and into said portion of said housing comprises:

a conduit interconnecting said portion of said housing with said needle valve;

a stop plate between said diaphragm means and said needle valve on said opposite side of said diaphragm means and having an opening therethrough; and a chamber between said needle valve and said stop plate for receiving fluid passed through said needle valve from said interconnecting conduit, and for charging control fluid through the opening in said stop plate to a position between said stop plate and said opposite side of said diaphragm means.

12. A pumping system as defined in claim 11 wherein said check valve subassembly comprises:

a suction chamber;

a suction check valve positioned between said suction chamber and said pump chamber;

a discharge chamber; and a discharge check valve positioned between said discharge chamber and said pump chamber.

13. A fluid-operated pumping system comprising:

a main pump adapted to be powered by a relatively high pressure fluid to pump a fluid from a relatively low pressure to a higher pressure and including:

a main power cylinder;

a power piston reciprocably mounted in the power cylinder and dividing the power cylinder into a power chamber and a pump chamber;

an actuator cylinder;

an actuator piston reciprocably mounted in the actuator cylinder and connected to the power piston for mutual reciprocation therewith; and a check valve subassembly associated with the pump chamber in the main power cylinder for alternately admitting fluid into said pump chamber during a suction stroke of the power piston, and discharging fluid from said pump chamber during a discharge stroke of the power piston;

a transfer valve for directing said relatively high pressure fluid in alternating fashion to said power chamber and into said actuator cylinder to drive said power piston and actuator piston in reciprocation, and concurrently receiving and circulating low pressure fluid from said main pump, said transfer valve comprising:

a first chamber connected to said actuator cylinder for receiving pressurized fluid therefrom and alternately supplying pressurized fluid thereto;

a second chamber connected to said power chamber for receiving pressurized fluid therefrom and alternately supplying pressurized fluid thereto;

a first pressurized fluid charging chamber;

a second pressurized fluid charging chamber;

means for concurrently supplying a pressurized fluid to said first and second pressurized fluid charging chambers;

a fluid discharge chamber;

a double seat core element partially positioned in said fluid discharge chamber and including tubular stem means for communicating said discharge chamber with said first and second chambers; and compound spherical valve element means positioned between said first chamber and said first pressurized fluid charging chamber, between said first pressurized fluid charging chamber and said tubular stem means, between said second pressurized fluid charging chamber and said tubular stem means, and between said second chamber and said second pressurized fluid charging chamber; and a needle valve controlled pilot valve connected to and controlling the movements of, said transfer valve.

14. A pumping system as defined in claim 13 wherein said pilot valve comprises:

valve housing means;

diaphragm means in said housing means and movable from a first control position to a second control position in response to changes in fluid pressure acting on at least one side of said diaphragm means;

first valve means moveable in response to movement of said diaphragm means to periodically reduce the pressure in a control fluid within a portion of said housing means on one side of the diaphragm means;

a needle valve operatively associated with said diaphragm means to control the rate of increase of fluid pressure acting on the opposite side of said diaphragm means from that side upon which fluid pressure is periodically reduced by movement of said first valve means;

means for concurrently charging a fluid under pressure through said needle valve into said housing means on said opposite side of said diaphragm means, and into said portion of said housing means on said one side of said diaphragm means, said means for concurrently charging a control fluid comprising:

a conduit interconnecting said portion of said housing with said needle valve;

a stop plate between said diaphragm means and said needle valve on said opposite side of said diaphragm means and having an opening therethrough; and a chamber between said needle valve and said stop plate for receiving fluid passed through said needle valve from said interconnecting conduit, and for charging control fluid through the opening in said stop plate to a position between said stop plate and said opposite side of said diaphragm means; and means connecting said portion of said housing means on one side of said diaphragm means to said transfer valve for communicating fluid between said portion of said housing means and said transfer valve; and wherein said check valve subassembly comprises:

a suction chamber;

a suction check valve position between said suction chamber and said pump chamber;

a discharge chamber; and a discharge check valve positioned between said discharge chamber and said pump chamber.

15. A pumping system as defined in claim 13 wherein said means for concurrently supplying a pressurized fluid comprises:

a source of pressurized fluid; and conduit means connected to said first and second pressurized fluid charging chambers and to said source of pressurized fluid.

16. A pumping system as defined in claim 13 wherein said compound spherical valve element means comprises:

a first spherical valve element adapted to isolate said first chamber from said first pressurized fluid chamber;

a second spherical valve element adapted to isolate said first pressurized fluid chamber from said fluid discharge chamber by seating on said tubular stem means;

a first rod interconnecting said first and second spherical valve elements and extending coaxially with said tubular stem means;

a third spherical valve element adapted to isolate said second chamber from said second pressurized fluid chamber;

a fourth spherical valve element adapted to isolate said second pressurized fluid chamber from said fluid discharge chamber by seating on said tubular stem means; and a second rod interconnecting said third and fourth spherical valve elements and extending coaxially with said tubular stem means.

17. A pumping system as defined in claim 14 wherein said double seat core element comprises:

a pressure-responsive diaphragm;

disc means connected to said diaphragm and movable therewith and defining fluid flow passageway means communicating with said discharge chamber;

an upwardly projecting tubular stem on said disc means and having a first valve seat at the upper end thereof contacting said compound valve element means, and further having a fluid passageway therethrough communicating with said fluid flow passageway means for conveying fluid from said first chamber to said discharge chamber via said fluid flow passageway means;

a downwardly projecting tubular stem on said disc means and having a second valve seat at the lower end thereof contacting said compound valve element means, and further having a fluid passageway therethrough communicating with said fluid flow passageway means for conveying fluid from said second chamber to said discharge chamber via said fluid flow passageway means; and spring means bearing against said disc means and resiliently opposing movement of said disc means and diaphragm in one direction, said spring means being located on one side of said diaphragm.

18. A pumping system as defined in claim 17 wherein said transfer valve is further characterized in having:

a control fluid space on the opposite side of said diaphragm from said spring means; and a control fluid passageway communicating with said control fluid space and connected to said pilot valve for receiving control fluid therefrom.

19. A pumping system as defined in claim 17 wherein said pilot valve comprises:

valve housing means;

diaphragm means in said housing means and movable from a first control position to a second control position in response to changes in fluid pressure acting on at least one side of said diaphragm means;

first valve means movable in response to movement of said diaphragm means to periodically reduce the pressure in a control fluid within a portion of said housing means on one side of the diaphragm means;

a needle valve positioned in the housing means to control the rate of increase of fluid pressure acting on the opposite side of said diaphragm means from that side upon which fluid pressure is periodically reduced by movement of said first valve means;

means for concurrently charging a control fluid under pressure through said needle valve into said housing means on said opposite side of said diaphragm means, and into said portion of said housing means on said one side of said diaphragm means; and means connecting said portion of said housing means on one side of said diaphragm means to said transfer valve for communicating fluid between said portion of said housing means and said transfer valve.

20. A pumping system as defined in claim 19 wherein said connecting means comprises conduit means interconnecting said portion of said housing with said transfer valve to establish fluid communication between the fluid within said portion of said housing means and the side of said diaphragm opposite the side thereof upon which said spring means is located.

21. A pumping system as defined in claim 19 wherein said first valve means comprises:

a first pilot valve seat connected to, and movable with, said diaphragm means;

a first pilot valve spherical valve element seatable on said first pilot valve seat for blocking the flow of a control fluid into said portion of said housing means on one side of said diaphragm;

atmospheric vent passageway means communicating said portion of the housing means with the atmosphere outside the pilot valve;

a second pilot valve seat positioned in said atmospheric vent passageway means;

a second pilot valve spherical valve element seatable on said second pilot valve seat to block flow of fluid from said portion of said housing to the atmosphere; and a rigid rod interconnecting said first and second pilot valve spherical valve elements for concurrent movement.

22. A pumping system as defined in claim 21 wherein said connecting means comprises conduit means interconnecting said portion of said housing with said transfer valve to establish fluid communication between the fluid within said portion of said housing means and the side of said diaphragm opposite the side thereof upon which said spring means is located.

23. A pumping system as defined in claim 22 wherein said means for concurrently charging a control fluid through said needle valve into said housing means, and into said portion of said housing, comprises:

a conduit interconnecting said portion of said housing with said needle valve;

a stop plate between said diaphragm means and said needle valve on said opposite side of said diaphragm means and having an opening therethrough; and a chamber between said needle valve and said stop plate for receiving fluid passed through said needle valve from said interconnecting conduit, and for charging control fluid through the opening in said stop plate to a position between said stop plate and said opposite side of said diaphragm means.

24. A pumping system as defined in claim 23 wherein said check valve subassembly comprises:

a suction chamber;

a suction check valve positioned between said suction chamber and said pump chamber;

a discharge chamber; and a discharge check valve positioned between said discharge chamber and said pump chamber.

25. A pumping system as defined in claim 21 wherein said means for concurrently supplying a pressurized fluid comprises:

a source of pressurized fluid; and conduit means connected to said first and second pressurized fluid charging chambers and to said source of pressurized fluid.

* * * * *

UNITED STATES PATENT AND TRADEMARK OFFICE

CERTIFICATE OF CORRECTION

PATENT NO. : 4,439,114

DATED : March 27, 1984

INVENTOR(S) : Garman O. Kimmell

It is certified that error appears in the above-identified patent and that said Letters Patent are hereby corrected as shown below:

Column 11, line 68, change "92" to --192--.

Column 12, line 57, change "presurized" to --pressurized--.

Claim 2, line 22, change "dischage" to --discharge--.

Claim 7, line 3, change "changing" to --charging--.

Claim 17, line 1, change "14" to --13--.

Claim 25, line 1, change "21" to --24--.

Signed and Sealed this

*Sixteenth* Day of *October 1984*

[SEAL]

*Attest:*

GERALD J. MOSSINGHOFF

*Attesting Officer*

*Commissioner of Patents and Trademarks*